US006155821A

United States Patent [19]

Hellum

[11] Patent Number: 6,155,821

[45] Date of Patent: Dec. 5, 2000

[54] BURNER ASSEMBLY FOR A STOVE

[75] Inventor: Mads Hellum, Oslo, Norway

[73] Assignee: Optimus International AB, Stockholm, Sweden

[21] Appl. No.: 09/365,331

[22] Filed: Jul. 30, 1999

[51] Int. Cl.[7] ..... F23D 14/62

[52] U.S. Cl. ..... 431/354; 431/355; 431/350; 431/171

[58] Field of Search ..... 431/8, 171, 172, 431/397, 348, 349, 350, 355, 354; 239/498, 499, 548, 552, 553, 553.5

[56] References Cited

U.S. PATENT DOCUMENTS

| | | | |
|---|---|---|---|
| 2,541,315 | 2/1951 | West | 431/172 |
| 2,855,034 | 10/1958 | Jahn | 431/353 |
| 3,212,556 | 10/1965 | Johansson | 431/347 |
| 3,754,853 | 8/1973 | Braucksiek et al. | 431/347 |
| 3,820,945 | 6/1974 | Vignes | 431/349 |
| 4,134,719 | 1/1979 | Velie | 431/286 |

FOREIGN PATENT DOCUMENTS

| | | | |
|---|---|---|---|
| 2652483 | 4/1991 | France | 239/499 |

*Primary Examiner*—Ira S. Lazarus
*Assistant Examiner*—David Lee
*Attorney, Agent, or Firm*—Jones, Day, Reavis & Pogue

[57] ABSTRACT

A burner assembly for a multi-fuel stove includes a nozzle that is vertically oriented during operation of the stove wherein the nozzle is connected to a number of flanges that extend along and in directions away from the nozzle and have upper portions extending up to a level that is above the nozzle and have channels formed between them for the passage of gas. By this arrangement, different fuels including petrol to photogen and even fuels with higher vaporization temperatures can be effectively vaporized and burned.

4 Claims, 1 Drawing Sheet

BURNER ASSEMBLY FOR A STOVE

BACKGROUND OF THE INVENTION

1. Field of the Invention

The present invention relates generally to a burner assembly for a stove and, more particularly, to a burner assembly for a multi-fuel stove having a shortened heating time effectively vaporize the fuel supplied to it.

2. Description of the Related Art

A burner for a multi-fuel stove, which is normally used in the field but that can naturally also be used in other situations where access to other forms of fuel energy is not available, normally includes a valve housing that includes a nozzle as well as an outer wall or burner housing the valve housing. The valve housing is provided with a means of being connected to suitable fuel with a valve control. To start up the burner, the valve housing is warmed up with the help of pre-heating fuel and, after the valve housing has been warmed up, i.e. when pre-heating is complete, the valve is opened and the pressurized fuel is released so that it emerges through the nozzle. The fuel is heated to vaporization temperature by the preheated valve housing burner housing and thus leaves the nozzle in a gaseous form for ignition. With these known burners, the heat transfer for vaporizing the fuel takes place during operation via the normally perforated outer wall. The vaporization temperature achieved is thus in many cases insufficient, which is why it is difficult to use fuels with high vaporization temperatures such as, for example, photogen. For this reason, fuels with lower vaporization temperatures such as, for example, petrol, are normally used for these multi-purpose stoves.

SUMMARY OF THE INVENTION

The present invention improves over the prior art by providing a burner assembly for a multi-fuel stove including a nozzle that is vertically orientated during operation of the stove wherein the nozzle is connected to a number of flanges that extend along and in directions away from the nozzle and have upper portions extending up to a level that is above the nozzle and have channels formed between them for the passage of the gas. By this arrangement, different fuels including petrol to photogen and even fuels with higher vaporization temperatures can be effectively vaporized and burned.

BRIEF DESCRIPTION OF THE DRAWINGS

The foregoing and other novel features and advantages of the invention will be better understood upon a reading of the following detailed description taken in conjunction with the accompanying drawing wherein.

DETAILED DESCRIPTION OF THE PREFERRED EMBODIMENTS

Figure 1:
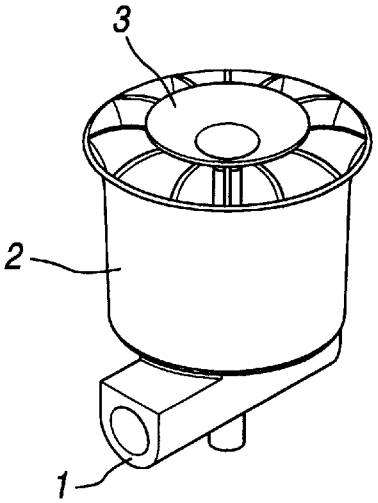
FIG. 1 is a perspective view of a burner assembly constructed in accordance with the principles of the invention.

Referring now to the drawings, a burner assembly constructed according to the invention preferably consists of valve housing 1, an outer wall or burner housing 2 open at the top and a burner plate 3. The valve housing includes a fuel connection and adjusting valve that are not dealt with further in this context, as well as a nozzle 4 that is essentially vertically oriented during the operation of the stove.

Figure 2:
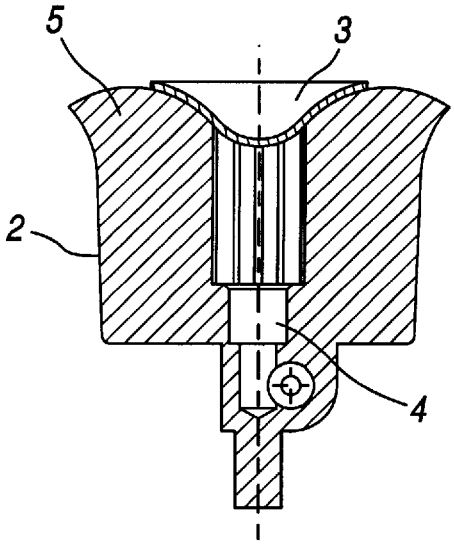
FIG. 2 is a cross-sectional view thereof.
Figure 3:
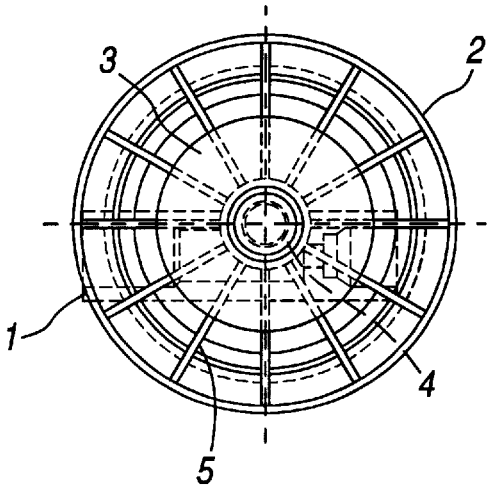
FIG. 3 is a top view thereof.
Figure 4:
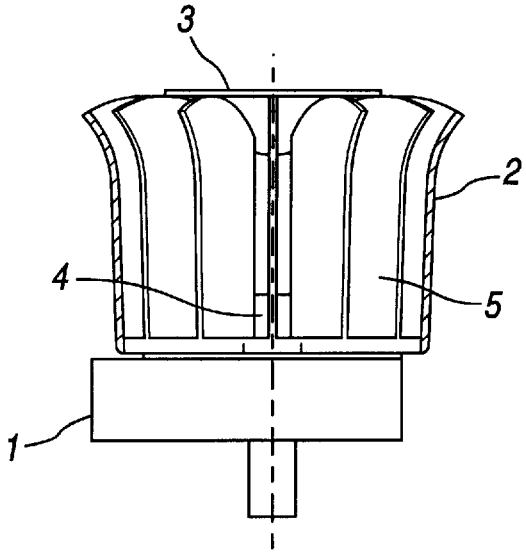
FIG. 4 is a side view of the burner assembly shown partially broken away.

According to the invention, a number of flanges 5 are connected to the body of the burner that includes the valve housing 1 and the nozzle 4 in a manner so that they run outwards or radially in a direction away from the nozzle and where the upper parts extend to a level above the nozzle 4. The position and orientation of the flanges 5 is clearly evident from FIGS. 3 and 4, whereby it should be realized that FIG. 4 shows the burner seen with the wall of the burner housing partially removed. FIG. 2 shows a practical embodiment where the valve housing 1 with the nozzle 4 can be considered to be cast in one piece with the flanges 5 and burner housing 2. This gives efficient heat conduction during the operation of the burner.

As will be appreciated particularly from FIG. 2, the burner plate 3 has a special form that is essentially "partly sinus-shaped", which effectively leads the flames towards the flanges during ignition and operation of the burner.

When the burner according to the invention is functioning, the flames of the gas will come into contact with the burner plate 3 that deflects the flames radially outwards in a sideways direction and past the upper parts of the flange 5. These are thus heated up and the heat is led down via the flanges directly to the valve housing, which shortens the heating up time of the burner when compared with the equivalent burners of today.

Due to this efficient, direct heating of the valve housing with the nozzle by the flames, it is possible to use fuels with high vaporization temperatures, as has been mentioned previously. Manufacturing the burner housing, valve housing and flanges can naturally be achieved in a number of different ways, but they all give the described example efficient conduction of heat back to the valve housing and nozzle.

While the present invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A burner assembly for a multi-fuel stove including a nozzle that is essentially vertically oriented during operation of the stove, wherein the nozzle is connected in intimate contact to a plurality of flanges that extend along and in directions away from the nozzle and have upper portions that extend up to a level that is above the nozzle and form channels between the adjacent flanges for the passage of gas, and wherein the nozzle and flanges are surrounded and in intimate contact with a burner housing that is open at its top and a burner plate is connected to upper edges of the flanges.

2. The burner assembly according to claim 1 wherein the flanges are arranged to extend substantially radially between the nozzle and the burner housing.

3. The burner assembly according to claim 1 wherein the nozzle has a longitudinal axis and the flanges extend generally parallel to said longitudinal axis.

4. The burner assembly according to claim 1 wherein the burner plate is substantially circular in shape and has a cross-section that is essentially partly sinus shaped with a convex side facing the flanges.

* * * * *